US011839949B2

(12) United States Patent
Liu et al.

(10) Patent No.: US 11,839,949 B2
(45) Date of Patent: Dec. 12, 2023

(54) GRINDING AND POLISHING DEVICE

(71) Applicant: TRIPLE WIN TECHNOLOGY(SHENZHEN) CO. LTD., Shenzhen (CN)

(72) Inventors: Long-Fei Liu, Shenzhen (CN); Yen-Sheng Lin, New Taipei (TW); Gao-Yang Deng, Shenzhen (CN); Yao-Wei Hong, Shenzhen (CN); Xue Peng, Shenzhen (CN)

(73) Assignee: TRIPLE WIN TECHNOLOGY(SHENZHEN) CO. LTD., Shenzhen (CN)

( * ) Notice: Subject to any disclaimer, the term of this patent is extended or adjusted under 35 U.S.C. 154(b) by 585 days.

(21) Appl. No.: 16/951,850

(22) Filed: Nov. 18, 2020

(65) Prior Publication Data

US 2022/0126415 A1 Apr. 28, 2022

(30) Foreign Application Priority Data

Oct. 27, 2020 (CN) ..... 202011166279.2

(51) Int. Cl.
*B24B 7/07* (2006.01)

(52) U.S. Cl.
CPC ..... *B24B 7/07* (2013.01)

(58) Field of Classification Search
CPC .. B24B 7/06; B24B 7/07; B24B 37/27; B24B 37/30; B24B 41/06; B25B 1/00; B25B 1/24; B25B 1/08; B25B 5/00; B25B 5/166; B25B 5/087
USPC ..... 451/278, 365
See application file for complete search history.

(56) References Cited

U.S. PATENT DOCUMENTS 4,555,100 A * 11/1985 Ditto ..... B25B 5/166 269/286
4,969,638 A * 11/1990 Yang ..... B25B 1/2426 269/261
5,738,568 A * 4/1998 Jurjevic ..... B24B 37/30 451/287

FOREIGN PATENT DOCUMENTS

| | | | | |
|---|---|---|---|---|
| CN | 206855231 U | | 1/2018 | |
| CN | 109176192 A | | 1/2019 | |
| EP | 0104286 A1 | * | 9/1982 | ..... B25B 1/20 |
| EP | 0238734 A1 | | 9/1987 | |
| TW | 367911 U | | 8/1999 | |
| TW | M390837 U1 | | 10/2010 | |

* cited by examiner

*Primary Examiner* — Kristina N Junge
*Assistant Examiner* — Sidney D Hohl
(74) *Attorney, Agent, or Firm* — ScienBiziP, P.C.

(57) ABSTRACT

A grinding and polishing device includes a main body, a grinding disk, a sample disk, a first console, and a second console. The main body includes a support table and a support column. The support table is coupled to the support column. The grinding disk is fixed on the support table and includes a polishing surface. The sample disk is fixed on the support column and configured to hold a preform. The first console is electrically coupled to the sample disk and used for controlling a distance between the preform held by the sample disk and the grinding disk. The second console is electrically coupled to the grinding disk and used for controlling a working state of the grinding disk for grinding and polishing the preform.

8 Claims, 9 Drawing Sheets

GRINDING AND POLISHING DEVICE

FIELD

The subject matter herein generally relates to a grinding and polishing device for grinding and polishing a preform.

BACKGROUND

Existing grinding and polishing machines include manual grinding and polishing machines and automatic grinding and polishing machines. The manual grinding and polishing machine has disadvantages of low safety performance, low stability, and low work efficiency. The working efficiency of the automatic grinding machine is high, but the automatic grinding machine is not suitable for preforms of different shapes and sizes, and a polishing thickness is uncontrollable.

BRIEF DESCRIPTION OF THE DRAWINGS

Implementations of the present disclosure will now be described, by way of embodiments, with reference to the attached figures.

DETAILED DESCRIPTION

Figure 1:
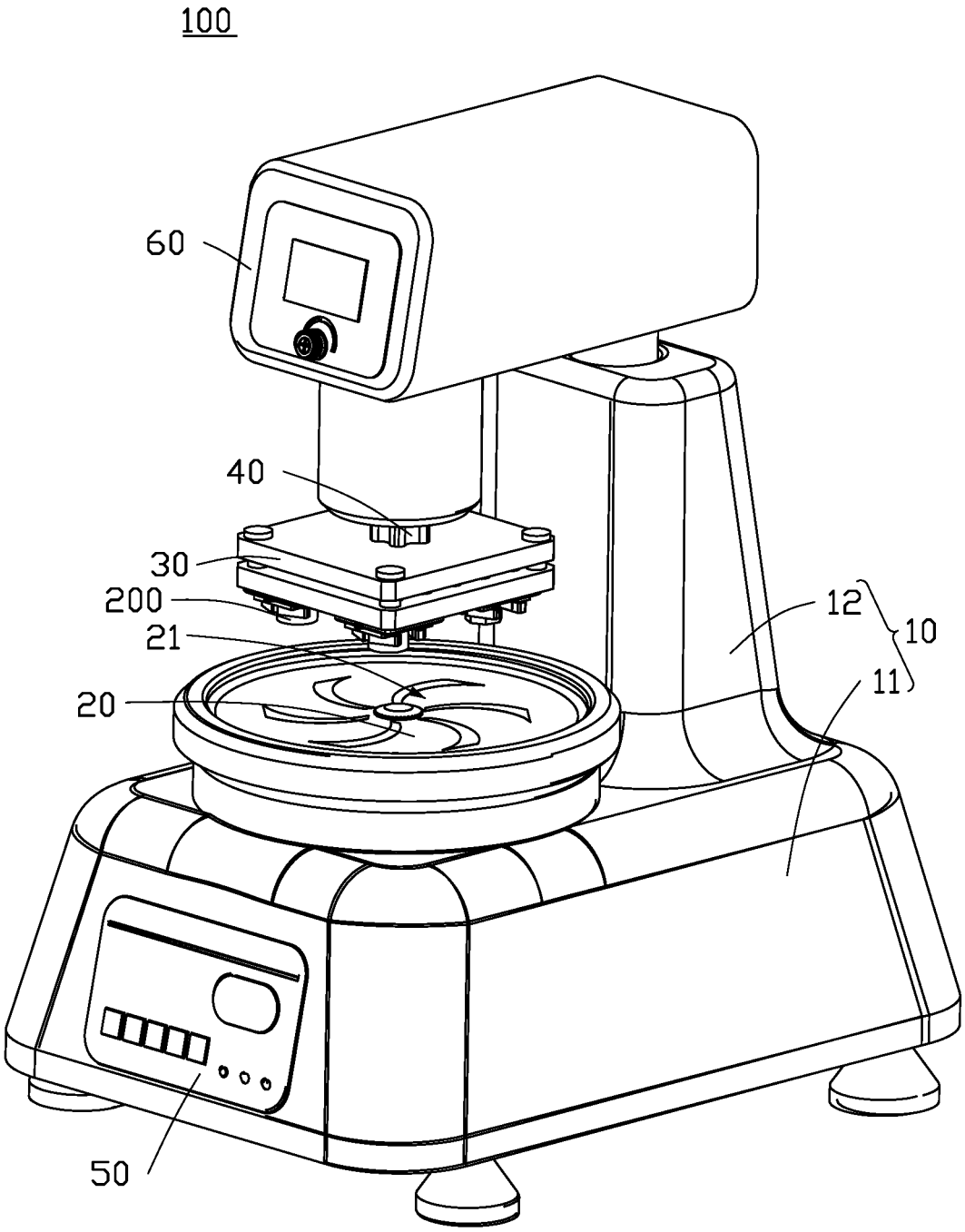
FIG. 1 is a schematic diagram of a grinding and polishing device provided by an embodiment of the present disclosure.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or another word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like.

FIG. 1 shows an embodiment of a grinding and polishing device 100. The grinding and polishing device 100 is used to clamp a preform 200 and perform grinding and polishing treatment on the preform 200 to obtain a finished product with a smooth surface.

The grinding and polishing device 100 includes a main body 10, a grinding disk 20, a sample disk 30, a first console 50, and a second console 60. The grinding disk 20 is fixed on the main body 10. The sample disk 30 is movably arranged on the main body 10 and faces the grinding disk 20. The sample disk 30 is used to fix the preform 200 in position. The first console 50 is coupled to the grinding disk 20 and is used to control a rotation speed of the grinding disk 20. The second console 60 is coupled to the sample disk 30 and used to control movement of the sample disk 30.

The main body 10 includes a support table 11 and a support column 12. The support column 12 is arranged on the support table 11. The support column 12 and the support table 11 are coupled to each other. The grinding disk 20 is arranged on the support table 11, and the sample disk 30 is movably arranged on the support column 12.

The grinding disk 20 includes a polishing surface 21 facing away from the support table 11. The sample disk 30 is arranged at an end of the support column 12 away from the support table 11. The sample disk 30 is used for holding the preform 200 toward the polishing surface 21, and the grinding disk 20 is rotated to polish the preform 200 held by the sample disk 30.

Specifically, the sample disk 30 is movably disposed on the support column 12 through a telescopic member 40. One end of the telescopic member 40 is directly or indirectly coupled to the support column 12, and another end of the telescopic member 40 is coupled to the sample disk 30. The telescopic member 40 is used to adjust a distance between the sample disk 30 and the grinding disk 20.

Figure 2:
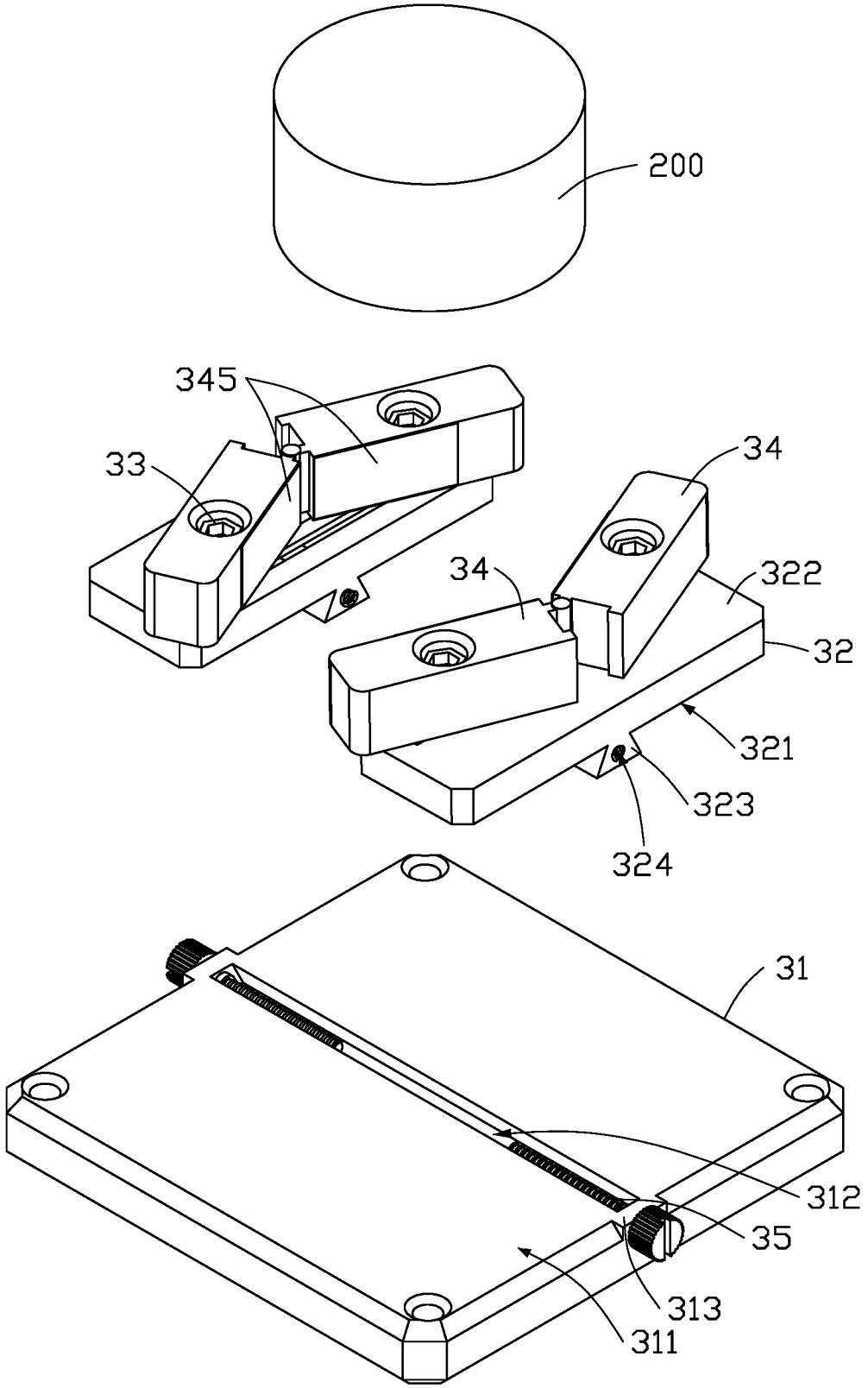
FIG. 2 is an exploded diagram of a sample disk of the grinding and polishing device.

Referring to FIG. 2, the sample disk 30 includes a base 31, a bracket 32, a fastener 33, a clamp 34 and a positioning knob 35. The sample disk 30 is fixed to the telescopic member 40 through the base 31. In one embodiment, the base 31 is fixed to the telescopic member 40 by screws.

The base 31 includes a fixing surface 311. The fixing surface 311 faces the grinding disk 20 and is substantially parallel to the polishing surface 21.

A first sliding groove 312 is defined in the fixing surface 311. A direction in which the first sliding groove 312 extends on the fixing surface 311 is defined as a first direction L1, a direction parallel to the fixing surface 311 and perpendicular to the first direction L1 is defined as a second direction L2, and a direction perpendicular to the first direction L1 and the second direction L2 is defined as a third direction L3.

Figure 3:
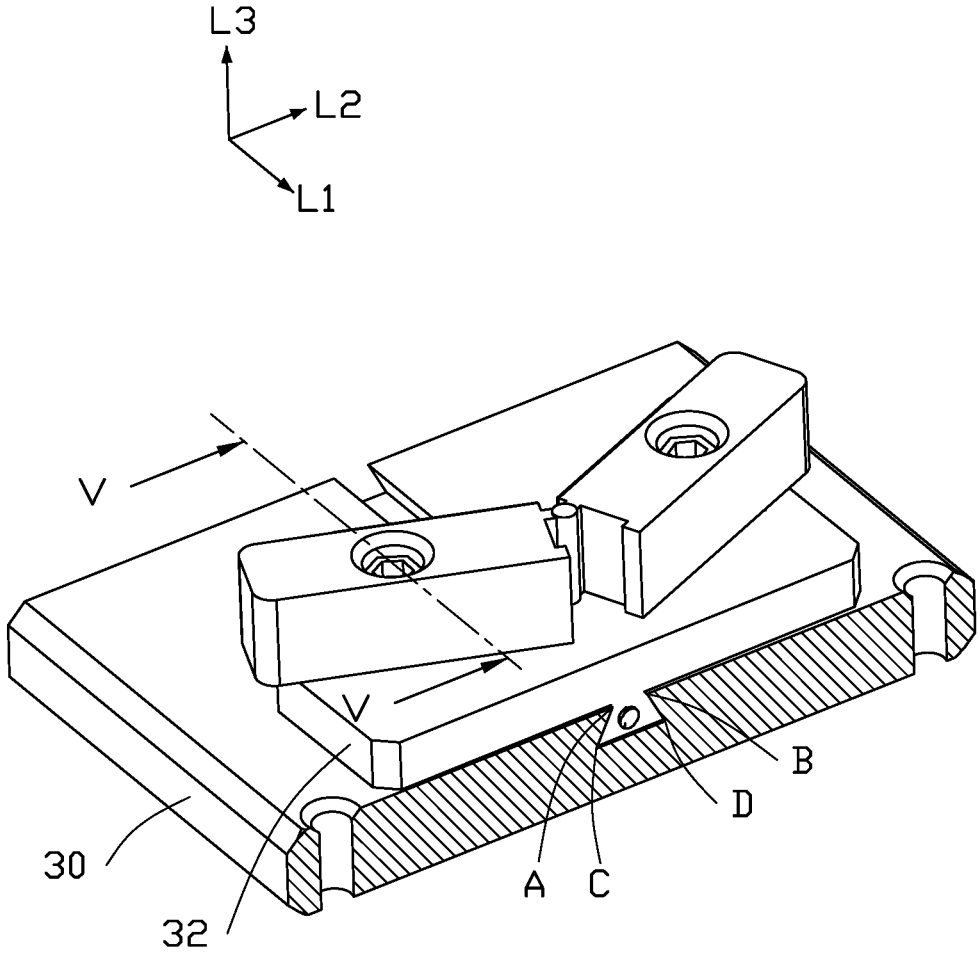
FIG. 3 is a schematic diagram of the sample disk shown in FIG. 2.

Referring to FIG. 3, a cross-section of the first sliding groove 312 taken along a direction perpendicular to the first direction L1 intersects the fixing surface 311 at a first point A and a second point B. A distance between the point A and the point B is defined as a distance D1. At least one plane that is different from the fixing surface 311 and parallel to the fixing surface 311 intersects the cross-section of the first sliding groove 312 along the direction perpendicular to the first direction L1 at a third point C and a fourth point D. A distance between the third point C and the fourth point D is defined as a distance D2. The distance D1 is less than the distance D2. In one embodiment, the cross-section is a trapezoid, and the trapezoid is smaller at an end toward the fixing surface 311 and larger away from the fixing surface 311. In other embodiments, the cross-section may be an ellipse or another irregular shape that meets the above conditions.

A number of the brackets 32 on the base 31 is two, and each bracket 32 includes a first surface 321 and a second surface 322. The first surface 321 is opposite to the second surface 322. A first protrusion 323 is located on the first surface 321 and corresponds to the first sliding groove 312. The second surface 322 is fixed with the clamp 34. The first protrusion 323 is embedded in the first sliding groove 312 and can slide along the first sliding groove 312, thereby driving the clamp 34 to move.

In one embodiment, a cross-sectional shape of the first protrusion 323 along the direction perpendicular to the first direction L1 is trapezoidal, so that the first protrusion 323 embedded in the first sliding groove 312 prevents the bracket 32 from separating from the base 31.

The first protrusion 323 defines a receiving hole 324 penetrating the first protrusion 323 along the first direction L1, and the receiving hole 324 is configured to receive the positioning knob 35. An inner wall of the receiving hole 324 is provided with an internal thread, and an outer wall of the positioning knob 35 is provided with an external thread adapted to the internal thread. Each of two ends of the first sliding groove 312 is provided with a blocking portion 313. When the bracket 32 is closely attached to the preform 200, that is, when the first protrusion 323 is located at a certain position in the first sliding groove 312, the positioning knob 35 passes through an opening between one of the blocking portions 313 and the first sliding groove 312 and passes through the receiving hole 324 of the first protrusion 323, so that the positioning knob 35 fixes the bracket 32 at a certain position of the base 31.

Figure 4:
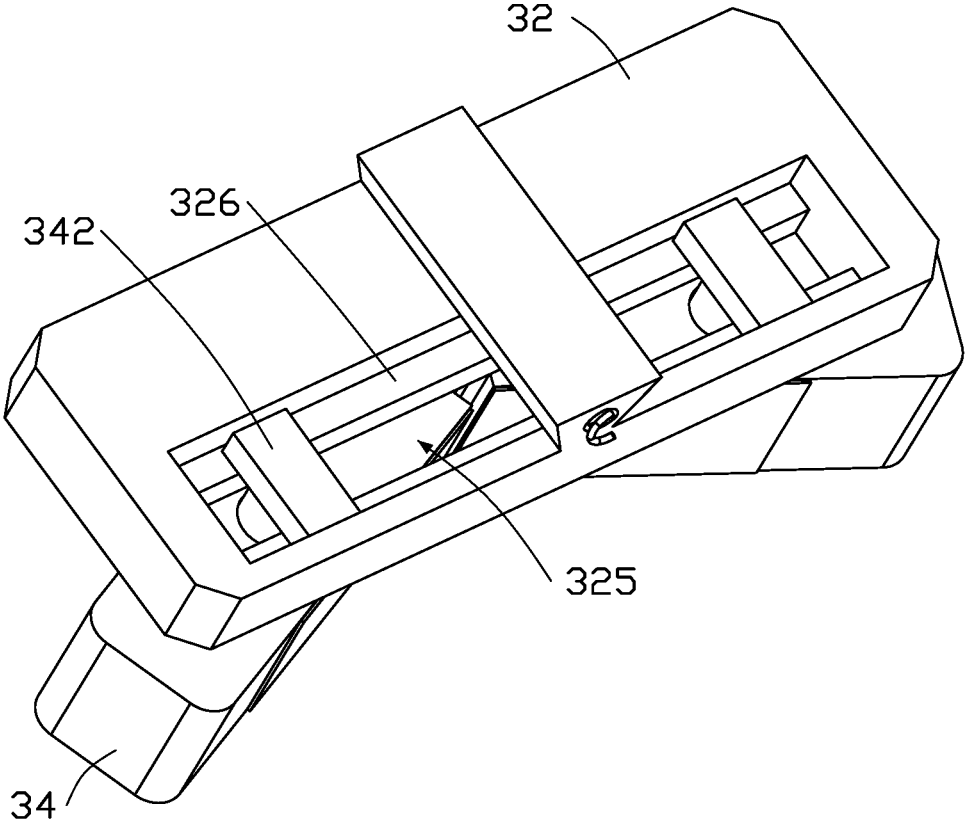
FIG. 4 is a schematic diagram of a clamp set on a bracket.

Referring to FIG. 4, each of the brackets 32 defines a second sliding groove 325 penetrating through the first surface 321 and the second surface 322. The second sliding groove 325 extends along the second direction L2. In one embodiment, the second sliding groove 325 is a through hole. Each of the clamps 34 is rotationally arranged on the bracket 32. When the clamp 34 is rotated to a certain angle, the clamp 34 is fixed to the bracket 32 by a fastener 33. In one embodiment, the fastener 33 is a screw.

The bracket 32 further includes a second protrusion 342 and defines a recessed portion 326 that is recessed inwardly on the second surface 322 along a side wall of the second sliding groove 325. The recessed portion 326 is used to accommodate a portion of the second protrusion 342, so that the second protrusion 342 slides along the second sliding groove 325 and prevents the clamp 34 from falling off the bracket 32. A number of the clamps 34 fixed on each bracket 32 is two, so that four clamps 34 are provided on each base 31. A surface of each clamp 34 is provided with the second protrusion 342. The second protrusion 342 is embedded in the second sliding groove 325 and can slide along the second sliding groove 325 to drive the clamp 34 to move.

Figure 5:
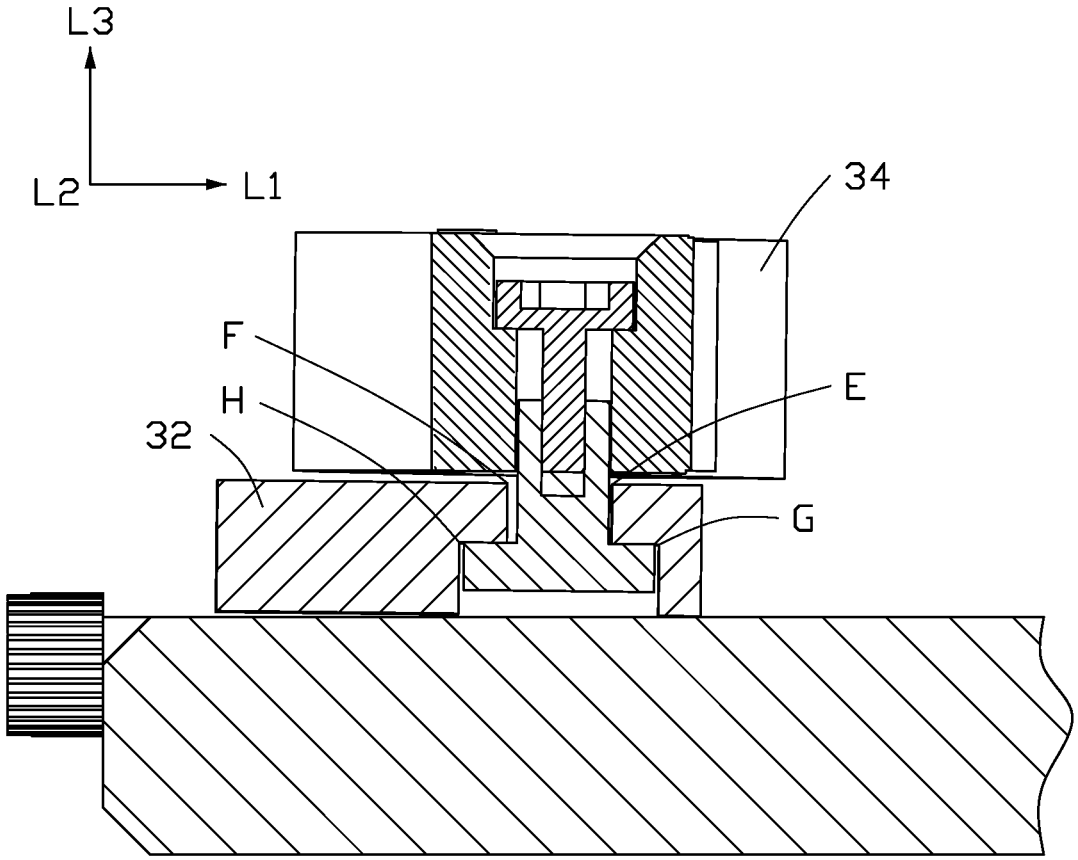
FIG. 5 is a cross-sectional diagram of the sample disk taken along line V-V in FIG. 3.

Referring to FIG. 5, a cross-section of the second sliding groove 325 taken along a direction perpendicular to the second direction L2 intersects the first surface 321 at a fifth point E and a sixth point F. A distance between the fifth point E and the sixth point F is defined as a distance D3. At least one plane that is different from the first surface 321 and parallel to the first surface 321 intersects the cross-section of the second sliding groove 325 along the direction perpendicular to the second direction L2 at a seventh point G and an eighth point H. A distance between the seventh point G and the eighth point H is defined as a distance D4. The distance D3 is less than the distance D4. In one embodiment, a cross-sectional shape of the second sliding groove 325 is stepped, and the stepped shape is smaller toward the first surface 321 and larger toward the second surface 322. In other embodiments, the cross-sectional shape may be trapezoidal, elliptical, or another irregular shape that meets the above conditions.

The second protrusion 342 substantially matches the second sliding groove 325. In one embodiment, a cross-sectional shape of the second protrusion 342 is stepped. In other embodiments, the cross-sectional shape of the second protrusion 342 may be trapezoidal, elliptical, or other irregular shapes that meet the above conditions.

Figure 6:
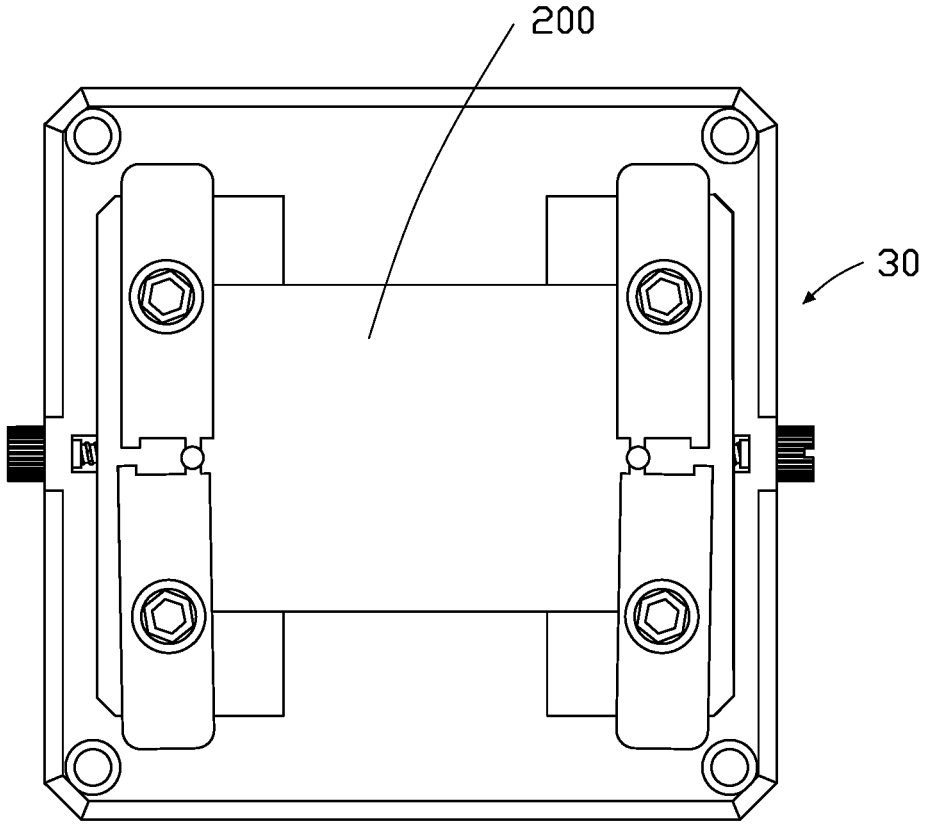
FIG. 6 is a schematic diagram of the sample disk holding a preform having a rectangular parallelepiped shape.

Referring to FIG. 6, when the preform 200 has a cubic shape with two parallel surfaces, such as a cube or a rectangular parallelepiped, each of the brackets 32 may not be provided with the second sliding groove 325, and the clamp 34 may not be provided with the second protrusion 342, and the preform 200 can be clamped by controlling a relative distance of the two brackets 32 on the base 31 along the two parallel surfaces of the cube or cuboid. In another embodiment, when the preform 200 is a cube or a cuboid or another shape having two parallel surfaces, each of the brackets 32 may be provided with the second sliding groove 325, and the clamp 34 may be provided with the second protrusion 342.

Figure 7:
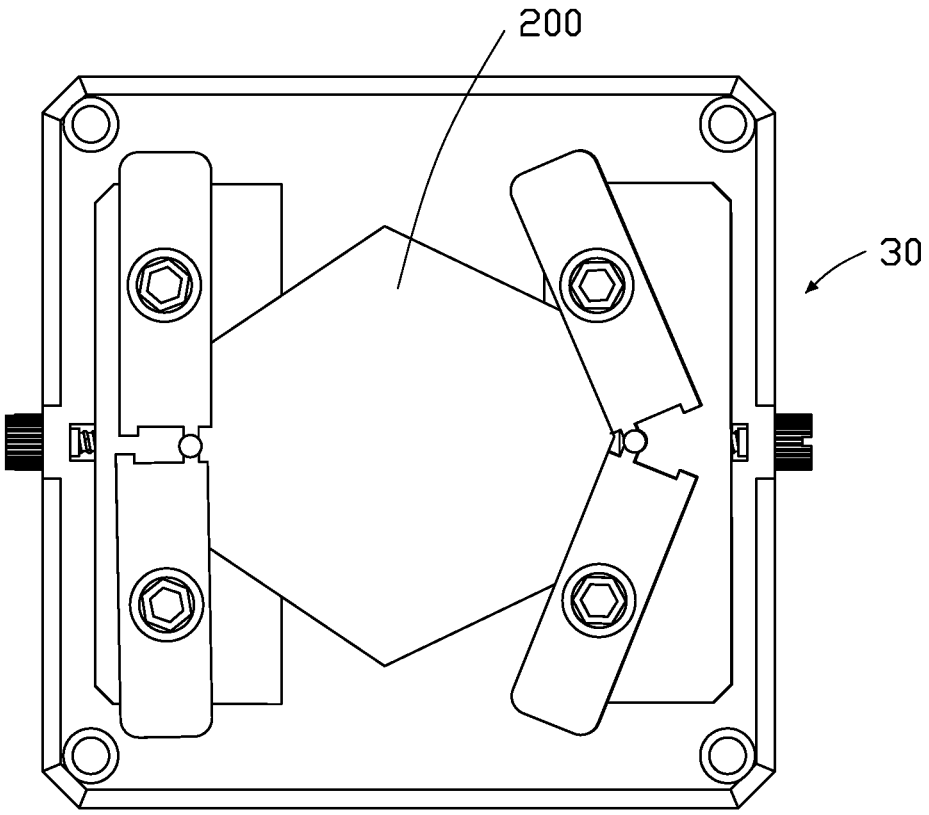
FIG. 7 is a schematic diagram of the sample disk holding a preform having a seven-sided shape.

Referring to FIG. 7, when the preform 200 is a regular or irregular polygonal structure, such as a seven-sided prism, at least one of the brackets 32 is provided with the second sliding groove 325, and the corresponding clamp 34 is provided with the second protrusion 342. The preform 200 can be clamped by rotating the angle of the clamp 34 and adjusting the relative distance between the two brackets 32.

Figure 8:
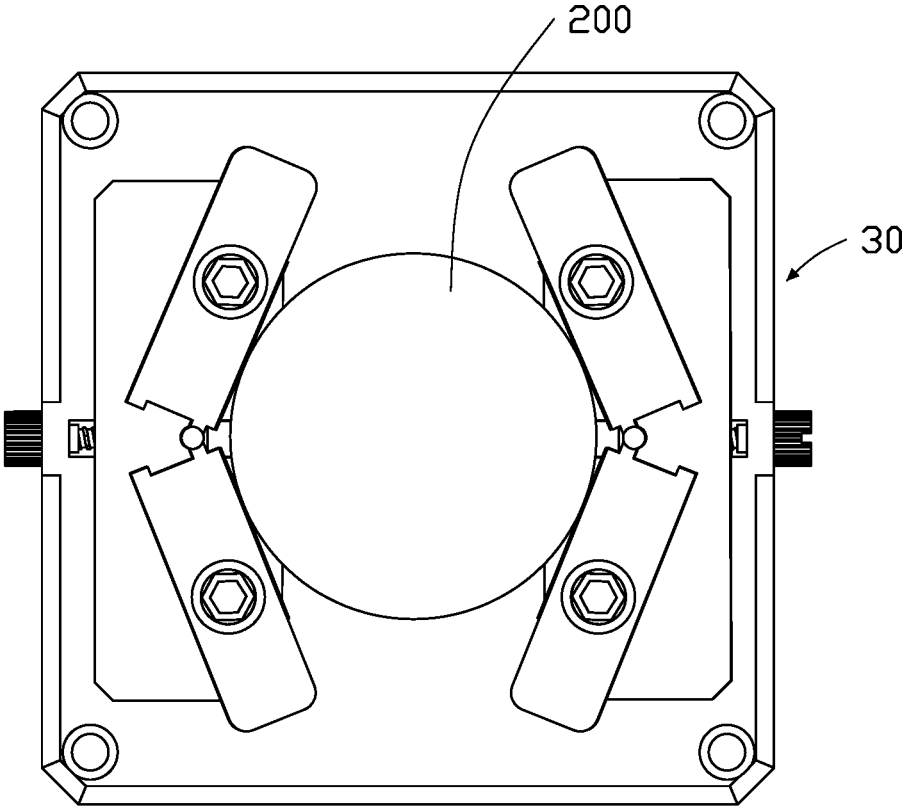
FIG. 8 is a schematic diagram of the sample disk holding a preform having a cylindrical shape.

Refer to FIG. 8, when the preform 200 is a round structure having a curved surface, such as a cylindrical or elliptical column, at least one of the brackets 32 is provided with the second sliding groove 325, the corresponding clamp 34 is provided with the second protrusion 342, and at least three brackets 32 have a contact point with the preform 200. The at least three contact points between the brackets 32 and the preform 200 are not on a same straight line to ensure that the preform 200 can be clamped and fixed. In other embodiments, the second sliding groove 325 can be provided on two brackets 32, and the second protrusion 342 can be provided on the corresponding two clamps 34.

Referring again to FIG. 2, a surface of each clamp 34 for contacting with the preform 200 is provided with a first elastic member 345. The first elastic member 345 may be a polymer film that provides an anti-slip function and prevents the clamp 34 from damaging the preform 200 due to an excessive clamping force.

Figure 9:
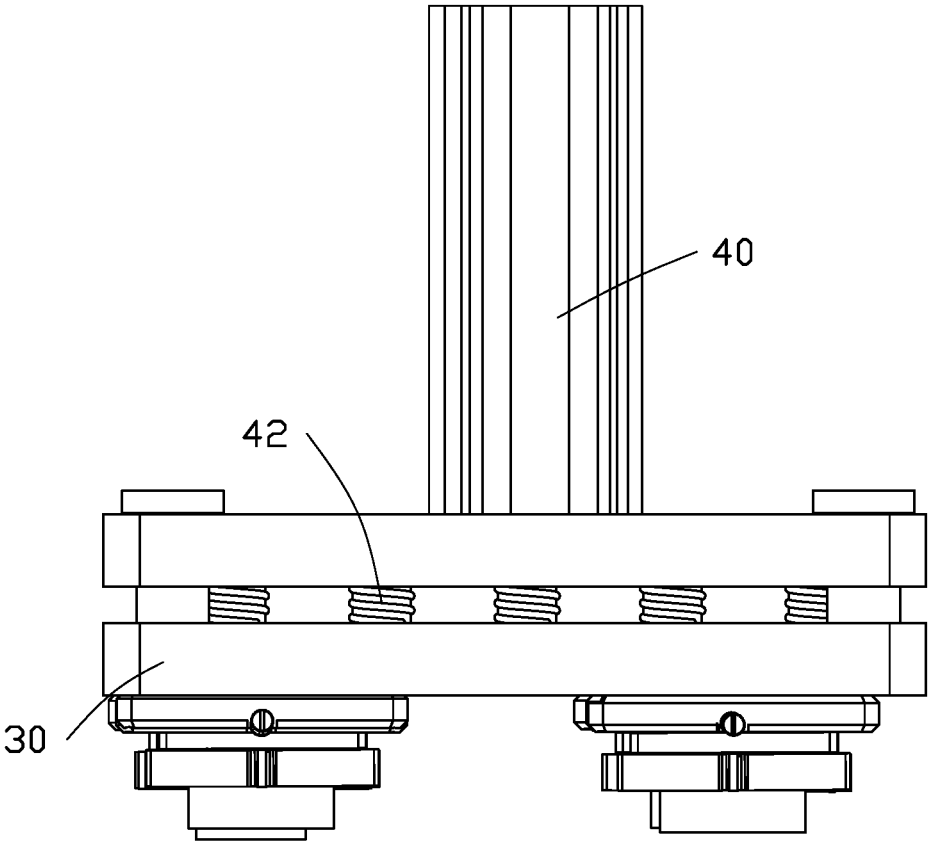
FIG. 9 is a schematic diagram of a second elastic member provided between a base and a telescopic member.

Referring to FIG. 9, a second elastic member 42 is provided between the base 31 and the telescopic member 40. The second elastic member 42 may be a spring or a polymer material having elasticity. During operation of the grinding and polishing device 100, the second elastic member 42 is used to buffer pressure of the sample disk 30 and absorb shock.

The first console 50 is electrically coupled to the grinding disk 20 and is used to control a working state of the grinding disk 20, such as a rotation speed, a working time, and the like. In one embodiment, the first console 50 is provided on the main body 10. In other embodiments, a position of the first console 50 is not limited.

The second console 60 is electrically coupled to the telescopic member 40 and used to control a telescopic length of the telescopic member 40 to control a distance between the sample disk 30 and the grinding disk 20, thereby facilitating the grinding disk 20 to polish the preform 200. In one embodiment, the second console 60 is located at an end of the support column 12 facing away from the support platform 11 and coupled to the telescopic element 40. In other embodiments, a position of the second console 60 is not limited.

The grinding and polishing device 100 can control the rotation speed of the grinding disk 20 through the first console 50, and control the distance between the preform 200 and the grinding disk 20 through the second console 60, which is beneficial to control a polishing thickness of the preform 200. Automatic grinding and polishing is achieved, and a production yield is improved. In addition, through the structural design of the sample plate 30, the preform 200 of any shape can be automatically ground and polished, so that the shape of the preform 200 is not limited.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A grinding and polishing device for clamping a preform and performing grinding and polishing treatment on the preform, the grinding and polishing device comprising:

a main body comprising a support table and a support column, the support table coupled to the support column;

a grinding disk fixed on the support table and comprising a polishing surface;

a sample disk fixed on the support column, the sample disk comprising:

a base comprising a fixing surface, the fixing surface facing the polishing surface and arranged parallel to the polishing surface;

two brackets movably arranged on the base;

fasteners for fixing the brackets on the base;

at least two clamps rotationally fixed on each of the brackets and used for clamping the preform; and a positioning knob for fixing the clamps on the brackets;

a first console electrically coupled to the sample disk and used for controlling a distance between the preform fixed by the sample disk and the polishing surface; and a second console electrically coupled to the grinding disk and used for controlling a working state of the grinding disk for grinding and polishing the preform;

wherein a first sliding groove is defined in the fixing surface, a direction in which the first sliding groove extends on the fixing surface is defined as a first direction, a direction parallel to the fixing surface and perpendicular to the first direction is defined as a second direction, and a direction perpendicular to the first direction and the second direction is defined as a third direction, each of the brackets comprises a first surface, a second surface opposite to the first surface, and a first protrusion on the first surface corresponding to the first sliding groove, the first protrusion is received in the first sliding groove, a second sliding groove is defined penetrating through the first surface and the second surface and extending along the second direction, the clamp comprises a second protrusion corresponding to the second sliding groove, and the second protrusion is received in the second sliding groove, a cross-sectional shape of the second sliding groove along a direction perpendicular to the second direction is stepped.

2. The grinding and polishing device of claim 1, wherein:

a cross-section of the first sliding groove taken along a direction perpendicular to the first direction intersects the fixing surface at a first point and a second point;

a distance between the first point and the second point is defined as a distance D1;

at least one plane that is different from the fixing surface and parallel to the fixing surface intersects the cross-section of the first sliding groove along the direction perpendicular to the first direction at a third point and a fourth point;

a distance between the third point and the fourth point is defined as a distance D2; and the distance D1 is less than the distance D2.

3. The grinding and polishing device of claim 2, wherein:

a cross-sectional shape of the first sliding groove along the direction perpendicular to the first direction is trapezoidal or elliptical.

4. The grinding and polishing device of claim 2, wherein:

a cross-section of the second sliding groove taken along the direction perpendicular to the second direction intersects the first surface at a fifth point and a sixth point;

a distance between the fifth point and the sixth point is defined as a distance D3;

at least one plane that is different from the first surface and parallel to the first surface intersects the cross-section of the second sliding groove along the direction perpendicular to the second direction at a seventh point and an eighth point;

a distance between the seventh point and the eighth point is defined as a distance D4; and the distance D3 is less than the distance D4.

5. The grinding and polishing device of claim 4, wherein:

the bracket further defines a recessed portion that is recessed inwardly on the second surface along a side wall of the second sliding groove.

6. The grinding and polishing device of claim 1, wherein:

a surface of the clamp is provided with a first elastic member.

7. The grinding and polishing device of claim 1, further comprising a telescopic member, wherein:

the telescopic member is coupled to the sample disk and the support column.

8. The grinding and polishing device of claim 7, wherein:

a second elastic member is provided between the base and the telescopic member.

* * * * *